US005714456A

United States Patent [19]

Wint

[11] Patent Number: 5,714,456

[45] Date of Patent: Feb. 3, 1998

[54] PROCESS FOR MAKING DISCRETE WHITENING AGENT PARTICLES

[75] Inventor: Michael J. Wint, Grand Rapids, Mich.

[73] Assignee: Amway Corporation, Ada, Mich.

[21] Appl. No.: 616,208

[22] Filed: Mar. 15, 1996

[51] Int. Cl.[6] ..... C11D 11/00; C11D 3/42

[52] U.S. Cl. ..... 510/451; 510/324; 510/326; 510/394; 510/461; 510/495; 252/301.23; 8/550; 8/648

[58] Field of Search ..... 510/324, 326, 510/394, 461, 451, 495; 8/648, 550; 252/301.23

[56] References Cited

U.S. PATENT DOCUMENTS

| | | | |
|---|---|---|---|
| 2,791,564 | 5/1957 | Fleck | 252/301.2 |
| 3,726,813 | 4/1973 | Borrello | 252/539 |
| 3,824,189 | 7/1974 | Borello | 252/99 |
| 3,846,346 | 11/1974 | Conn . | |
| 4,142,044 | 2/1979 | Günther et al. | 542/464 |
| 4,294,711 | 10/1981 | Hardy et al. | 252/8.75 |
| 4,298,490 | 11/1981 | Lange et al. | 252/91 |
| 4,309,316 | 1/1982 | Lange et al. | 252/543 |
| 4,326,971 | 4/1982 | Wixon | 252/8.75 |
| 4,411,803 | 10/1983 | Wixon | 252/8.75 |
| 4,411,809 | 10/1983 | Wixon | 252/91 |
| 4,478,598 | 10/1984 | Meyer et al. | 8/648 |
| 4,666,740 | 5/1987 | Wixon | 427/214 |
| 4,863,626 | 9/1989 | Coyne et al. | 252/91 |
| 4,933,100 | 6/1990 | Ramachandran | 252/95 |
| 5,057,236 | 10/1991 | Petrin et al. | 252/79.1 |
| 5,073,295 | 12/1991 | Bruttel et al. | 252/301.19 |
| 5,082,578 | 1/1992 | Langer et al. | 252/8.7 |
| 5,225,100 | 7/1993 | Fry et al. | 252/174.25 |
| 5,415,806 | 5/1995 | Pepe et al. | 252/174.21 |
| 5,496,486 | 3/1996 | Staley | 252/189.1 |

FOREIGN PATENT DOCUMENTS

| | | |
|---|---|---|
| 0578872 | 1/1994 | European Pat. Off. . |
| 2267911 | 12/1993 | United Kingdom . |

*Primary Examiner*—Paul Lieberman
*Assistant Examiner*—Lorna M. Douyon
*Attorney, Agent, or Firm*—G. Peter Nichols; Brinks Hofer Gilson & Lione

[57] ABSTRACT

A process for preparing discrete whitening agent particles that includes the steps of providing a whitening agent, admixing a surfactant that is a solid in a temperature range of from about 32° F. (0° C.) to about 180° F. (82° C.) with the whitening agent to form a substantially homogenous mass, and forming the mixture into discrete particles. The particles are preferably formed by extruding the homogeneous mass through an extruder at an elevated temperature. The particles may be added to a powder detergent.

12 Claims, No Drawings

PROCESS FOR MAKING DISCRETE WHITENING AGENT PARTICLES

BACKGROUND OF THE INVENTION

The present invention relates to a process for making discrete whitening agent particles. Such particles may be suitable for admixture with powder laundry detergents, bleaching powders and other powder laundry products.

Whitening agents are added to laundry detergents in order to enhance the whiteness and brightness of the washed textiles. For example, fluorescent whitening agents (FWAs) are added to counteract the yellowing of cotton and synthetic fibers. FWAs are adsorbed on fabrics during the washing process. FWAs function by absorbing ultraviolet light, which is then emitted as visible light, generally in the blue wavelength ranges. The resultant light emission yields a brightening an whitening effect, which counteracts yellowing or dulling of the fabric.

If, however, the whitener, particularly a fluorescent whitener, is incorporated in solid washing powders in the customary manner, it has an exceedingly undesirable drawback. Frequently, the whitener causes the bulk appearance of the detergent to a deteriorate. Unattractive, yellow or greenish-yellow powders of reduced commercial value are produced. Without being bound by any particular theory, it is believed that the whitening agents interact with the detergent surfactants and the free moisture that is present in the bulk detergent, which causes the whitening agents to change forms and thus cause the bulk appearance of the detergent to change. This reaction appears to be particularly prevalent when the detergent contains a substantial amount of nonionic surfactant.

One solution that has been proposed is to select a fluorescent whitening agent that may be more stable in a detergent containing a high nonionic surfactant concentration. The drawback to such whitening agents is that they lack cold water performance and they are expensive.

Another solution that has been proposed is reported in U.S. Pat. Nos. 4,298,490 and 4,309,316 to Lange et al. In these patents, a fluorescent whitener such as a bis-styrylbiphenyl, a bis-triazoylstilbene or naphthotriazolylstilbene type, is dissolved or dispersed in a mixture of water and a polymer (polyvinyl alcohol or polyvinyl pyrrolidone) and then added to the detergent slurry which is then later dried. Alternatively, the whitener solution or dispersion may be spray dried, suspended in water, added to the detergent slurry and then spray dried. These methods, however, require many processing steps prior to incorporation into a detergent slurry.

It has now been discovered that a whitening agent can be formed into discrete particles so that the particles can advantageously be added to, for example, a powder detergent composition.

SUMMARY OF THE INVENTION

The present invention relates to a process of preparing discrete whitening agent particles that effectively renders the whitening agent substantially resistant to degradation yet allows, for sufficient solubility upon introduction into an aqueous medium, such as found during laundering. The process includes the steps of providing a whitening agent, admixing a surfactant that is a solid in a temperature range of from about 32° F. (0° C.) to about 180° F. (82° C.) with the whitening agent to form a substantially homogenous mass, and forming the mixture into discrete particles. The process may also include the step of mixing a plasticizer with the whitening agent and surfactant to produce a particle that is more pliable. In addition, various detergent ingredients may be incorporated as adjuncts so long as they do not deter from the sought after advantage resulting from forming the whitening agent into a discrete particle.

The whitening agent and surfactant are preferably mixed so that the ratio of surfactant to whitening agent is from about 1:1 to about 50:1, preferably from about 1:1 to about 25:1. It is believed that by providing at least an equal amount of surfactant and whitening agent the surfactant will substantially isolate or protect the whitening agent.

Preferably, the whitening agent is admixed with a surfactant and the resulting mixture is extruded through a die slot into discrete particles. In this preferred embodiment, the mixture is extruded through, for example, a screw type extruder. Although the die slot and therefore the extrudate may take any suitable shape, it has been found that a spaghetti shape provides the desired protection for the whitening agent yet allows the resulting particle to dissolve or disperse in an aqueous medium such as a laundry solution. When the extrudate takes the form of spaghetti, the extruder die hole diameter is preferably in the range of about 0.1 mm to about 5 mm. In addition, the average length of the resulting spaghetti particles ranges from about 0.1 mm to about 30 mm with about 95% thereof within a tolerance of about 0.5 mm to about 20 min.

DETAILED DESCRIPTION OF THE INVENTION AND PREFERRED EMBODIMENTS

In accordance with the present invention a process for making discrete whitening agent particles comprises providing a whitening agent, admixing a surfactant with the whitening agent to form a substantially homogeneous mass, and forming the homogeneous mass into discrete particles.

The whitening agents suitable for use in the present invention include the known fluorescent whitening agents. For example, it is believed that the whiteners disclosed in U.S. Pat. Nos. 4,294,711, 5,225,100, 4,298,490, 4,309,316, 4,411,803, 4,142,044, and 4,478,598 each incorporated herein by reference may be useful in the present invention. Desirably, the whitening agent is selected from the fluorescent whitening agents consisting of coumarins, diaminostilbenedisulfonic acids, diaminostilbenesulfonic acid-cyanuric chlorides, distyrylbiphenyls, naphthotriazoylstilbenes, pyrazolines, and mixtures thereof.

The coumarin type of whitening agents have the general formula:

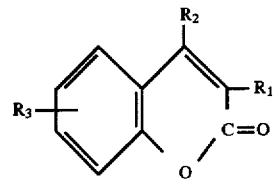

These coumarin whitening agents include 7-dimethylamino-4-methylcoumarin and 7-diethylamino-4-methylcoumarin.

The diaminostilbenesulfonic acid-cyanuric chlorides have the general formula:

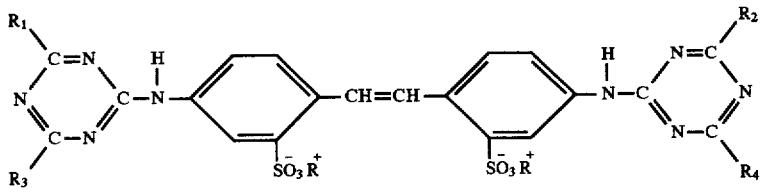

$R^+ = H^+, Na^+, K^+$, etc.

The diaminostilbenesulfonic acid-cyanuric chlorides include the 4,4'-Bis[(4,6-dianilino-s-triazin-2-yl)amino]-2,2' stilbenedisulfonic acids, or their alkali metal or alkanolamino salts, in which the substituted group is either morpholine, hydroxyethyl methylamino, dihydroxyethylamino or methylamino; the 4,4'-Bis{{4-anilino-6-[bis(2-hydroxyethyl)amino]-s-triazin-2-yl}amino}-2,2'-stilbenedisulfonic acids; the 4,4'-Bis[(4-anilino-6-morpholino-s-triazin-2-yl)amino]-2,2'-stilbenedisulfonic acids; the 4,4'-Bis[[4-anilino-6[N-2-hydroxyethyl-N-methylamino]-s]triazin-2-yl]amino]-2,2'-stilbenesulfonic acid disodium salts; and the 4,4'-Bis[[4-anilino-6-[(2-hydroxylpropyl)amino]-s-triazin-2-yl]amino]-2,2'stilbenedisulfonic acid disodium salts.

The distyrylbiphenyl whitening agents have the general formula:

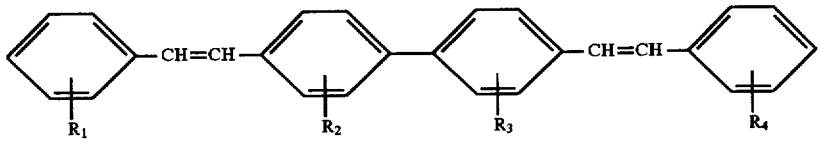

The distyrylbiphenyl whitening agents include the 2,2-(4,4'-Biphenylene divinylene)-dibenzenesulfonic acid, disodium salts. For example, Tinopal CBS (Ciba-Geigy) which is disodium 2,2'-bis-(phenyl-styrl) disulphonate may be useful. The 4-Benzooxazolyl-4'-oxadiazolyl stilbenes as disclosed in U.S. Pat. No. 4,142,044, the entire disclosure of which is hereby incorporated by reference, may also be suitable for use in the present invention.

The naphthotriazoylstilbene type whitening agents have the general formula:

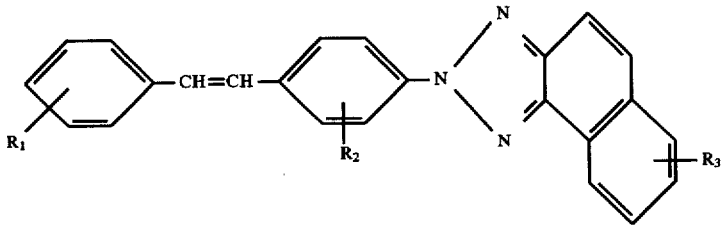

The naphthotriazoylstilbene type whitening agents include the 4-(2H-Naphtho[1,2-d]triazol-2-yl)-2-stilbenedisulfonic acid, sodium salts.

The pyrazoline type whitening agents have the general formula:

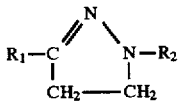

The pyrazoline type whitening agents include the p-[3-(p-Chlorophenyl)-2-pyrazolin-1yl]-benzenesulfonamides.

Preferably, the whitening agent is selected from the group consisting of the derivatives of disulfonated diaminostilbene/cyanuric chloride whiteners which have the general formula:

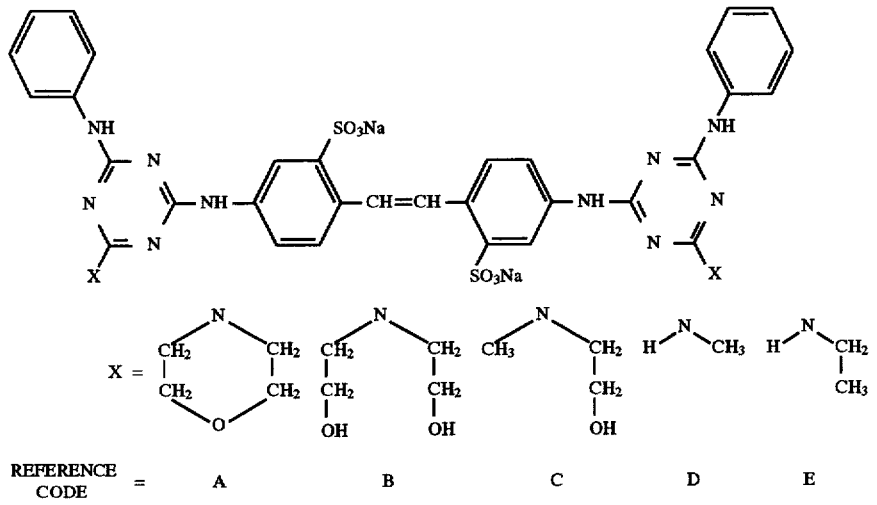

More preferably, the whitener is selected from the group of disulfonated diaminostilbene/cyanuric chloride whiteners wherein X has the formula A or C. An example of a whitener wherein X has the formula shown in A is the whitener marketed under the tradename Optiblanc 2M/G (by 3V Chemical Corp). When the 2M/G whitener is used, preferably the 2M/G LT version is used. An example of a whitener wherein X has the formula shown in C is Tinopal 5BM-GX.

The surfactant is selected to be compatible with detergent surfactants that are typically included in laundry detergents. Preferably, the surfactant is selected from the group consisting of those anionics, nonionics, zwitterionics, ampholytics, cationics, and mixtures thereof that are solids in a temperature range of from about 32° F. (0° C.) to about 180° F. (82° C.). Suitable surfactants are fully described in the literature, for example in "Surface Active Agents and Detergents" Volumes I and II by Schwartz, Perry & Berch in "Nonionic Surfactants" by M. J. Schick, and in McCutcheon's "Emulsifiers & Detergents," each of which are incorporated herein by reference.

It will be appreciated that by using a surfactant for the whitening agent particles, the cleaning ability of the laundry detergent will not be hindered and may indeed be augmented by the presence of additional surfactant, particularly if the particle surfactant is an anionic surfactant. Moreover, by using a surfactant, the end product particles have an acceptable solubility in an aqueous medium, particularly a laundering solution.

For example, it may be possible to use alkyl saccharides or highly ethoxylated acids or alcohols (e.g. those having from about 30 to about 80 moles of ethylene oxide per mole of acid or alcohol). Of course it will be understood by one skilled in the art that the nonionic surfactants will be, less desirable as compared to the anionic surfactants since nonionic surfactants generally affect not only the stability of the whitener but also their ability to effectively deposit on the fabric.

With the foregoing considerations in mind, nonionic surfactants may be useful in the instant process. Such nonionic materials include compounds produced by the condensation of alkylene oxide groups (hydrophilic in nature) with an organic hydrophobic compound, which may be aliphatic or alkyl aromatic in nature. Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol, with the higher ethylene oxide amounts being preferred.

Included are the water-soluble and water-dispersible condensation products of aliphatic alcohols containing from 9 to 22 carbon atoms, in either straight chain or branched configuration, with from greater than 12 moles of ethylene oxide per mole of alcohol. For example, preferred nonionic surfactants have the general formula $R^1(OC_2H_4)_nOH$, where $R^1$ is a $C_8$–$C_{20}$ alkyl group or a $C_8$–$C_{12}$ alkyl phenyl group, and n is from 12 to about 80.

Alkyl saccharides may also find use in the composition. In general, the alkyl saccharides are those having a hydrophobic group containing from about 8 to about 20 carbon atoms, preferably from about 10 to about 16 carbon atoms, and a polysaccharide hydrophillic group containing from about 1 (mono) to about 10 (poly), saccharide units (e.g., galactoside, glucoside, fructoside, glucosyl, fructosyl, and/or galactosyl units). Mixtures of saccharide moieties may be used in the alkyl saccharide surfactants. Preferably, the alkyl saccharides are the alkyl polyglucosides having the formula $$R^1O(C_nH_{2n}O)_t(Z)_x$$

wherein Z is derived from glucose, $R^1$ is a hydrophobic group selected from the group consisting of alkyl, alkylphenyl, hydroxyalkyl, hydroxyalkylphenyl, and mixtures thereof in which the alkyl groups contain from about 10 to about 18 carbon atoms, n is 2 or 3, t is from 0 to about 10, and x is from 1 to about 8. Examples of such alkyl saccharides are described in U.S. Pat. No. 4,565,647 (at col. 2, line 25 through col. 3, line 57) and U.S. Pat. No. 4,732,704 (at col. 2, lines 15–25), the pertinent portions of each are incorporated herein by reference.

It has been found that when the detergent surfactants comprising the laundry detergent include a substantial amount of nonionic surfactant, the surfactant in the whitening agent particle is preferably an anionic surfactant. More particularly, in the more preferred embodiment when a nonionic surfactant is the sole detergent surfactant, the particle surfactant is advantageously an anionic surfactant.

Useful anionic surfactants include the water-soluble salts of the higher fatty acids, i.e., soaps, may be useful in the present process. This includes alkali metal soaps such as the sodium, potassium, ammonium, and alkyl ammonium salts of higher fatty acids containing from about 8 to about 24 carbon atoms. Soaps can be made by direct saponification of fats and oils or by the neutralization of free fatty acids. Particularly useful are the sodium and potassium salts of the mixtures of fatty acids.

Useful anionic surfactants also include the water-soluble salts, preferably the alkali metal, ammonium and alkylolammonium salts, of organic sulfuric reaction products having in their molecular structure an alkyl group containing from about 8 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and alkylbenzene sulfonates in which the average number of carbon atoms in the alkyl group is from about 10 to 14, abbreviated as $C_{11-14}$ LAS. Preferably, the anionic surfactant is a sodium alkyl sulfate, wherein the alkyl portion has from about 8 to about 20 carbon atoms, such as, for example, sodium lauryl sulfate.

As indicated above, the anionic surfactants useful in the present invention may include the potassium, sodium, calcium, magnesium, ammonium or lower alkanolammonium, such as triethanolammonium, monoethanolammonium, or diisopropanolammonium paraffin or olefin sulfonates in which the alkyl group contains from about 10 to about 20 carbon atoms. The lower alkanol of such alkanolammonium will normally be of 2 to 4 carbon atoms and is preferably ethanol. The alkyl group can be straight or branched and, in addition, the sulfonate is preferably joined to any secondary carbon atom, i.e., the sulfonate is not terminally joined.

Other anionic surfactants that may be useful in the present invention include the secondary alkyl sulfates having the general formula

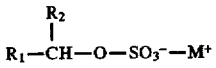

wherein M is potassium, sodium, calcium, or magnesium, $R_1$ represents an alkyl group having from about 3 to about 18 carbon atoms and $R_2$ represents an alkyl group having from about 1 to about 6 carbon atoms. Preferably, M is sodium, $R_1$ is an alkyl group having from about 10 to about 16 carbon atoms, and $R_2$ is an alkyl group having from about 1 to about 2 carbon atoms.

Other anionic surfactants herein are the sodium alkyl glyceryl ether sulfonates, especially those ethers of higher alcohols derived from tallow and coconut oil; sodium coconut oil fatty add monoglyceride sulfonates and sulfates; sodium or potassium salts of alkyl phenol ethylene oxide ether sulfates containing from about 1 to about 10 units of ethylene oxide per molecule and wherein the alkyl group contains from about 10 to about 20 carbon atoms.

The ether sulfates useful in the present invention are those having the formula $RO(C_2H_4O)_xSO_3M$ wherein R is alkyl or alkenyl having from about 10 to about 20 carbon atoms, x is 1 to 30, and M is a water-soluble cation preferably sodium. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Another example of anionic surfactants that may be useful in the present invention are those compounds which contain two anionic functional groups. These are referred to as di-anionic surfactants. Suitable di-anionic surfactants are the disulfonates, disulfates, or mixtures thereof which may be represented by the following formula:

$$R(SO_3)_2M_2,\ R(SO_4)_2M_2,\ R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

The whitener and surfactant are mixed in a ratio of surfactant to whitening agent from about 1:1 to about 50:1, preferably from about 1:1 to about 25:1. More preferably, the ratio of surfactant to whitening agent is in the range from about 2:1 to about 10:1 with the most preferable ratio being from about 2:1 to about 5:1. It is believed that, by providing at least an equal amount of surfactant and whitening agent that in the resulting particles, the surfactant will substantially isolate or protect the whitening agent.

Optionally, a plasticizer may be included in an amount to provide for a softer end product. The plasticizer may be any of the well known plasticizers in the extrusion art such as water, mineral oil, fatty alcohols, fatty acids, alkoxylated fatty acids, alkoxylated alcohols, including the salts of the fatty alcohols, fatty acids, alkoxylated fatty acids, and alkoxylated alcohols, and the like, and mixtures thereof.

Surprisingly, it has been found that nonionic surfactants are desirable plasticizing agents and may include the nonionic surfactants described above. In particular, the nonionic surfactants having the formula $R^1(OC_2H_4)_nOH$, where $R^1$ is a $C_8$–$C_{18}$ alkyl group or a $C_8$–$C_{12}$ alkyl phenyl group, and n is from 3 to about 80 are preferred. Particularly preferred nonionic surfactants are the condensation products of $C_{10}$–$C_{16}$ alcohols with from about 5 to about 20 moles of ethylene oxide per mole of alcohol, e.g., a $C_{12}$–$C_{15}$ alcohol condensed with about 6 to about 9 moles of ethylene oxide per mole of alcohol. Nonionic surfactants of this type include the NEODOL™ products, e.g., Neodol 23-6.5, Neodol 25-7, and Neodol 25-9 which are, respectively, a $C_{12-13}$ linear primary alcohol ethoxylate having 6.5 moles of ethylene oxide, a $C_{12-15}$ linear primary alcohol ethoxylate having 7 moles of ethylene oxide, and a $C_{12-15}$ linear primary alcohol ethoxylate having 9 moles of ethylene oxide.

When a plasticizer is included in the process of the present invention, it is incorporated at a level of no more than about 10% of the whitening agent particle end product. If too much plasticizer is included, the resulting end product is too pliable and cannot be effectively admixed into the detergent. Preferably, the plasticizer is included at a level of no more than about 5%, more preferably no more than about 3% of the whitening agent end product. At these levels the ratio of surfactant to plasticizer is at least about 2:1. Preferably, the ratio of surfactant to plasticizer is from at least about 5:1 up to about 50:1, more preferably up to about 30:1.

Other typical detergent ingredients may also be included so long as they do not deter from the sought after advantage resulting from forming the whitening agent into a discrete particle. In particular, such detergent ingredients as silicones, defoamers, citric acid, sodium carbonate, phosphates, and other builders may be incorporated in the mixture.

Preferably, the whitener and surfactant, and, optionally the plasticizer and other detergent ingredients, are mixed in the desired amounts to form a substantially homogeneous mass which can be worked according to well known techniques until it is sufficiently "doughy" or plastic to be in suitable form for, preferably, extrusion or other process, e.g., pelleting, granulation, stamping and pressing. As an example, the whitener and surfactant may be charged to a mixer where they are mixed while being sprayed with the plasticizer. The wetted mixture is then formed into discrete particles. Alternatively, the whitener may be continuously metered to a mixing tank separately from the surfactant which is also continuously metered to the mixing tank where the whitener and surfactant are mixed while being sprayed. An amount of the wetted mixture is continuously removed from the mixing tank and formed into discrete particles by, for example, an extrusion process.

It is contemplated that the surfactant could be sprayed onto the whitening agent to encapsulate the whitening agent. However, such a process would require solubilization or dispersion of the surfactant and subsequent drying after spraying the whitening agents, which necessarily requires additional processing steps. In addition, the drying may cause heat degradation of the whitening agent.

Preferably, the mixture is extruded through, for example, a screw type extruder. When the mixture is extruded, it is extruded at a die exit temperature of about 100° F. (38° C.) to about 180° F. (82° C.), preferably at a die exit temperature of about 130° F. (54° C.) to about 160° F. (71° C.). The extrusion die head may be selected in accordance with the desired shape, i.e., geometric form, desired in the extrudate. For example, the extrudate may take the shape of spaghetti or noodles, although other shaped forms such as flakes, tablets, pellets, ribbons, threads and the like are suitable alternatives. To provide a particle wherein the whitening agent is sufficiently protected, the die slot is preferably shaped so that the extrudate takes the shape of spaghetti. In this preferred shape, the die slot has a diameter of about 0.1 mm to about 5 mm with a preferred range of from about 0.5 mm to about 2.5 mm, more preferably from about 0.5 mm to about 1.5 mm. The die slot diameter determines the diameter of the resulting particle and in the process of the present invention the diameter of the resulting particle is approximately the same as the die slot diameter. Therefore, the particles of the present invention have a diameter of about 0.1 mm to about 5 mm with a preferred range of from about 0.5 mm to about 2.5 mm, more preferably from about 0.5 mm to about 1.5 min. Die slot diameters greater than about 5 mm will produce particles having a reduced dissolution rate as compared to those within the preferred range.

The spaghetti has an average length from about 0.1 mm to about 30 mm with about 95% thereof within a tolerance of about 0.5 mm to about 20 min. More preferably, the spaghetti has an average length from about 0.5 mm to about 10 mm. Most preferably, the average length is from about 1 to about 3 mm. An excessive length may lead to segregation of the particles during use. At the same time, an excessively short length may increase the total surface area of the extrudate which may cause increased surface dusting and bleeding of color from the whitening agent particles.

In a preferred embodiment, the process comprises the steps of preparing a homogenous mass consisting essentially of a whitening agent, a surfactant, and, optionally a plasticizer, wherein the whitening agent, surfactant and plasticizer are those described above; extruding the mass through a die extruder at an elevated temperature to provide an extrudate in the shape of spaghetti particles. In this preferred embodiment, it is desirable to exclude those additional ingredients that may adversely affect the solubility or stability of whitening agent. In a more preferred embodiment, the homogenous mass consists only of the essential ingredients; a whitening agent, a surfactant and, optionally a plasticizer wherein the whitening agent, surfactant and plasticizer are those described above.

In a preferred embodiment, the whitening agent and anionic surfactant are mixed while the plasticizer is sprayed onto the mixture. Thereafter, the resulting mixture is fed into a pressurized extruder, for example, a screw extruder, where the mixture is extruded into the desired shape. Alternatively, the whitening agent and anionic surfactant may be separately fed to a mixer where they are mixed while being sprayed with the plasticizer, preferably the nonionic surfactant.

The following examples are for illustrative purposes only and are not to be construed as limiting the invention.

EXAMPLES

Examples 1–15 in Tables 1–4 show a number of formulations to outline the scope of the whitening agent particles that may be useful in the present invention. Examples 1–10 show various types of anionic surfactants as well as whiteners to illustrate the range of surfactants and whiteners. Examples 12–15 show possible adjuncts to the particle compositions. Each of the compositions in Examples 1–15 were prepared by mixing each of the ingredients and then extruding them through a one inch extruder having mixing pins (Bonnot Co.).

TABLE 1

| Example No. | 1 | 2 | 3 | 4 |
|---|---|---|---|---|
| Sodium paraffin sulfate | 50 | — | — | — |
| Sodium lauryl sulfate | — | 50 | 50 | 50 |
| Tinopal CBS-X | 50 | 50 | 25 | — |
| Tinopal UNPA-GX | — | — | 25 | — |
| Optiblanc 2M/G LT | — | — | — | 50 |

TABLE 2

| Example No. | 5 | 6 | 7 | 8 |
|---|---|---|---|---|
| Sodium lauryl sulfate | 75 | 80 | 75 | 75 |
| Tinopal UNPA- | 25 | 20 | — | — |

TABLE 2-continued

| Example No. | 5 | 6 | 7 | 8 |
|---|---|---|---|---|
| GX | | | | |
| Tinopal CBS-X | — | — | 25 | — |
| Optiblanc 2M/G LT | — | — | — | 25 |

TABLE 3

| Example No. | 9 | 10 | 11 |
|---|---|---|---|
| Sodium stearate | 78 | 75 | 75 |
| Tinopal 5BM-GX | 22 | — | — |
| Tinopal CBS-X | — | 25 | — |
| Optiblanc 2M/G LT | — | — | 25 |

TABLE 4

| Example No. | 12 | 13 | 14 | 15 |
|---|---|---|---|---|
| Sodium lauryl sulfate | 50 | 60 | 70 | 72.5 |
| Sodium carbonate | 22.5 | 10 | 12.5 | 10 |
| Tinopal CBS-X | 20 | 22.5 | 10 | 10 |
| Fumaric acid | 7.5 | 7.5 | 7.5 | 7.5 |

In the following examples, the color of the detergent particles is measured to provide a Whiteness Index which can provide an indication of the degradation of the whitening agent. The color is measured using a sphere spectrophotometer Model SP68™ by X-Rite® to provide a Whiteness Index. The use of such a spectrophotometer is known to those skilled in the art. In general, several readings of the tested material are taken and then averaged to provide an average Whiteness Index.

Example 16

In the following example, a powder detergent containing whitening agent particles according to the present invention was tested to determine if the detergent exhibited undesirable color degradation. The detergent comprised 53.18% of sodium carbonate, 3% of silica, 2% of carboxymethylcellulose, 22% of Pareth 25-7 (a $C_{12}$–$C_{15}$ alcohol ethoxylated with 7 moles of ethylene oxide), 7.5% of citric acid for agglomeration, 4% of added water (of which 2.5% was removed by drying), 5% of post added acidulant (fumaric acid), 2.22% of detergent ingredients (brightener, fragrance, and enzyme), and 3.6% of a whitener particle that comprised sodium lauryl sulfate and Optiblanc 2M/G LT in a ratio of sodium lauryl sulfate to whitener of 3:1. Table 5 shows the average Whiteness Index at the start of the test, after one-month, and again after three-months at varying conditions.

TABLE 5

| Condition | 40° F. | 70° F/20% RH | 100° F/80% RH | 120° F. |
|---|---|---|---|---|
| Time | | | | |
| Initial | 66.86 | 66.86 | 66.86 | 66.86 |
| 1 month | 70.47 | 64.88 | 45.39 | 43.18 |
| 3 month | 70.33 | 64.87 | 30.62 | 42.06 |

Example 17

In the following example, the powder detergent of example 16 was used, except the particles comprised 73% sodium lauryl sulfate, 24% Optiblanc 2M/G LT, and 3% of Neodol 25-7. After 2 months at ambient temperature, the Whiteness Index was 70.85, and at 40° F. the Whiteness Index was 70.62, and at 120° F. the Whiteness Index was 56.90. Although the Whiteness Index after 2 months at 120° F. was less than at ambient temperature, it was still above the acceptable level of about 45.

Example 18

In the following example, a powder detergent containing 62.02% sodium carbonate, 2.8% of cellulose gum, 4.4% of sodium silicate, 3% of sodium citrate, 11.05% of a blend of Pareth 25-7 and Pareth 45-7 (a $C_{14}$–$C_{15}$ alcohol ethoxylated with 7 moles of ethylene oxide), 1.7% of Pareth 25-3 (a $C_{12}$–$C_{13}$ alcohol ethoxylated with 3 moles of ethylene oxide), 2.1% of quaternary ammonium chloride, 11% of liquid sodium silicate, 4.88% of detergent ingredients (fragrances, enzymes, sodium hydroxide, disperant, terpolymer, brightener), loss of 3% of water to drying, and 0.6% of Optiblanc 2M/G LT was tested after 3 weeks and after 6 weeks. The Optiblanc 2M/G LT was simply post-added to the powder detergent and was not formulated into a particle in accordance with the present invention. Table 6 shows the rapid degradation in the bulk color of the detergent when the whitening agent is not formulated as a particle in accordance with the present invention.

TABLE 6

| Condition | 70° F/20% RH | 120° F. |
|---|---|---|
| Time | | |
| Initial | 60.69 | 60.69 |
| 3 weeks | 52.19 | 38.98 |
| 6 weeks | 53.07 | 30.26 |

Although the present invention has been described particularly for use with whitening agents, it is contemplated that the process would be useful for isolating or protecting a variety of adjuvants included in powdered detergents. For example, it is contemplated that the process may be useful for isolating or protecting bleaching agents, wool and nylon brighteners, enzymes, cationic and other softeners.

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A process for preparing discrete solid whitening agent particles comprising:

a. providing a whitener selected from the group consisting of diaminostilbenedisulfonic acids, diaminostilbenesulfonic acid-cyanuric chlorides, and mixtures thereof; a surfactant selected from the group consisting of anionics, nonionics, zwitterionics, ampholytics, cationics, and mixtures thereof that are solids in a temperature range of from about 32° F. (0° C.) to about 180° F. (82° C.), wherein the ratio of surfactant to whitener is in the range of about 2:1 to about 5:1, and, optionally, a plasticizer in an amount up to about 10% wherein the plasticizer is a nonionic surfactant having the formula $R^1(OC_2H_4)_nOH$, where $R^1$ is a $C_8$–$C_{18}$ alkyl group or a $C_8$–$C_{12}$ alkyl phenyl group, and n is from 3 to about 80;

b. admixing the whitener with the surfactant and, optionally, the plasticizer, to form a homogeneous mass; and, c. forming the mass into discrete particles that consist of the whitener, surfactant, and optionally the plasticizer such that the particle reduces degradation of the whitener.

2. The process of claim 1 wherein the surfactant is an anionic surfactant.

3. The process of claim 2 wherein the surfactant is an anionic surfactant selected from the group consisting of alkali metal, ammonium and alkylolammonium salts of organic sulfuric reaction products having in their molecular structure an alkyl group containing from about 10 to about 20 carbon atoms and a sulfonic acids or sulfuric acid ester group.

4. The process of claim 1 wherein the mass is extruded through a die at an elevated temperature to produce an extrudate particle.

5. The process of claim 4 wherein the mass is extruded through a die slot having a diameter of about 0.1 mm to about 5 mm so that the extrudate is in the shape of spaghetti.

6. The process of claim 5 wherein the extradate has a length of from about 0.1 mm to about 30 mm.

7. A process for preparing extruded whitening agent particles consisting essentially of:

a. providing a composition consisting of a whitener, a surfactant and, optionally a plasticizer in an amount up to about 10%; wherein the whitener is selected from the group consisting of diaminostilbenedisulfonic acids, diaminostilbenesulfonic acid-cyanuric chlorides and mixtures thereof, the surfactant is an anionic surfactant that is a solid in a temperature range of from about 32° F. (0° C.) to about 180° F. (82° C.) and wherein the plasticizer is a nonionic surfactant having the formula $R^1(OC_2H_4)_nOH$, where $R^1$ is a $C_8$–$C_{18}$ alkyl group or a $C_8$–$C_{12}$ alkyl phenyl group, and n is from 3 to about 80;

b. admixing the whitener, surfactant and, optionally the plasticizer to form a homogeneous mass; and, c. extruding the mass to form particles having an average length from about 0.5 mm to about 10 mm and a diameter between about 0.5 mm to about 2.5 mm, wherein the ratio of the surfactant to whitener is from about 2:1 to about 5:1 such that the particle reduces degradation of the whitener.

8. The process of claim 7 wherein the whitener is a diaminostilbenedisulfonic acid.

9. The process of claim 7 wherein the surfactant is an anionic surfactant selected from the group consisting of alkali metal, ammonium and alkylolammonium salts of organic sulfuric reaction products having in their molecular structure an alkyl group containing from about 10 to about 20 carbon atoms and a sulfonic acid or sulfuric acid ester group.

10. The process of claim 9 wherein the whitener is a diaminostilbenedisulfonic acid.

11. The process of claim 7 wherein the plasticizer is admixed with the whitener and surfactant in an amount no greater than about 10% prior to extruding the mass and wherein the ratio of the surfactant to the plasticizer is from about 5:1 to about 30:1.

12. A process for preparing extruded whitening agent particles consisting essentially of:

a. providing a composition consisting of a diaminostilbenesulfonic acid whitener, an anionic surfactant, and, optionally a plasticizer in an amount up to about 10% wherein the plasticizer is a nonionic surfactant having the formula $R^1(OC_2H_4)_nOH$, where $R^1$ is a $C_8$–$C_{18}$ alkyl group or a $C_8$–$C_{12}$ alkyl phenyl group, and n is from 3 to about 80;

b. admixing the whitener, surfactant, and, optionally the plasticizer, to form a homogeneous mass; and, c. extruding the mass to form particles having an average length from about 0.5 mm to about 10 mm and a diameter between about 0.5 mm to about 2.5 mm, wherein the ratio of the surfactant to whitener is from about 2:1 to about 5:1 such that the particle protects the whitener from degradation.

* * * * *

UNITED STATES PATENT AND TRADEMARK OFFICE

CERTIFICATE OF CORRECTION

PATENT NO. : 5,714,456
DATED : February 3, 1998
INVENTOR(S) : Michael J. Wint

It is certified that error appears in the above-identified patent and that said Letters Patent is hereby corrected as shown below:

In the Claims

In claim 1, line 1, please delete "solid".

In claim 1, line 12, after "10%", please insert --;-- (semicolon).

In claim 6, line 1, please change "extradate" to --extrudate--.

In claim 7, line 7, after "chlorides", please insert --,-- (comma).

In claim 7, line 10, after "(82°C.)", please insert --;-- (semicolon).

Signed and Sealed this

Twelfth Day of September, 2000

*Attest:*

Q. TODD DICKINSON

*Attesting Officer*

*Director of Patents and Trademarks*